US005504796A

United States Patent [19]

Da Silveira et al.

[11] Patent Number: 5,504,796

[45] Date of Patent: Apr. 2, 1996

[54] METHOD AND APPARATUS FOR PRODUCING X-RAYS

[76] Inventors: Enio F. Da Silveira, 802 Spring Loop, College Station, Tex. 77840; Kevin B. Ray, 931 Parma Dr., Ballwin, Mo. 63021; Emile A. Schweikert, 3706 Sunnybrook La., Bryan, Tex. 77802; Melvin A. Park, 4116 Kincaid Dr., Raleigh, N.C. 27604; William D. James, 2709 Mirkwood Ct., Bryan, Tex. 77807

[21] Appl. No.: 347,656

[22] Filed: Nov. 30, 1994

[51] Int. Cl.[6] ..... H01J 35/14

[52] U.S. Cl. ..... 378/121; 378/113; 378/138

[58] Field of Search ..... 378/113, 119, 378/121, 122, 137, 138, 139

[56] References Cited

U.S. PATENT DOCUMENTS 5,374,826 12/1994 LaRue et al. ..... 250/397

OTHER PUBLICATIONS

J. L. Wiza, "Microchannel Plate Detectors", *Nuclear Instruments and Methods,* vol. 162, 587–601, (1979).

E. A. Kurz, "Channel Electron Multipliers", *American Laboratory,* Mar. 1979.

R. A. Zubarev, et al., "Electron Avalanche Desorption: a New Soft–ionization Technique for Non–volatile and/or Thermally Labile Molecules", *Rapid Communications in Mass Spectrometry,* vol. 5.

R. A. Zubarev, et al., "Comparision of Mass Spectra Obtained Using $^{252}$Cf Plasma–avalanche–desorption and Electron–desorption Mass Spectrometry", *Rapid Communications in Mass Spectrometry,* vol. 5, 278–282 (1991).

B. L. Henke, et al., eds., "Proceedings of the Eighteenth Annual Conference on Applications of X–Ray Analysis Held Aug. 6–8, 1969", *Advances in X–Ray Analysis,* vol. 13, (1970).

C. D. McAfee, "Spontaneous Desorption: Field Assisted Ion Induced Desorption Mass Spectrometry", Office of Graduate Studies of Texas A&M University, (1990).

F. Jamet and G. Thomer, *Flash Radiography,* Elsevier Scientific Publishing Company, (1976).

L. S. Birks, et al., "Excitation of Characteristic X Rays by Protons, Electrons, and Primary X Rays", *Journal of Applied Physics,* vol. 35, No. 9, (1964).

P. Engström, et al., "X–Ray Capillary Optics", Conference Proceedings, vol. 25, 2nd European Conference on Progress in X–ray Synchrotron Radiation Research, A. Balerna, et al. (Eds.), SIF, Bologna, (1990).

T. Nordmeyer and K. A. Prather, "Real–Time Measurement Capabilities Using Aerosol Time–of–Flight Mass Spectrometry", *Anl. Chem.* vol. 66, pp. 3540–3542 (1994).

*Primary Examiner*—David P. Porta

[57] ABSTRACT

A portable x-ray tube 68 for producing x-rays, the tube 68 having an energy source 74 which directs energetic particles or photons at an electron multiplier 80 coupled to the energy source 74. A voltage source 84 applies a multiplier voltage across the electron multiplier 80. When triggered by the energy source 74, the electron multiplier 80 creates a multitude of electrons 28 directed towards a target anode 90 that receives the electrons and produces x-rays 30. The target anode 90 is coupled at a voltage difference of at least 3 kV relative to the electron multiplier 80 so as to define an electron acceleration region 32 between the electron multiplier 80 and the target anode 90. The target anode 90 contains an element having an atomic number greater than 11. A low pressure enclosure 70 contains the electron multiplier 80 and the target anode 90. The low pressure enclosure 70 includes a window 92 for allowing the x-rays 30 to pass through substantially unchanged.

32 Claims, 6 Drawing Sheets

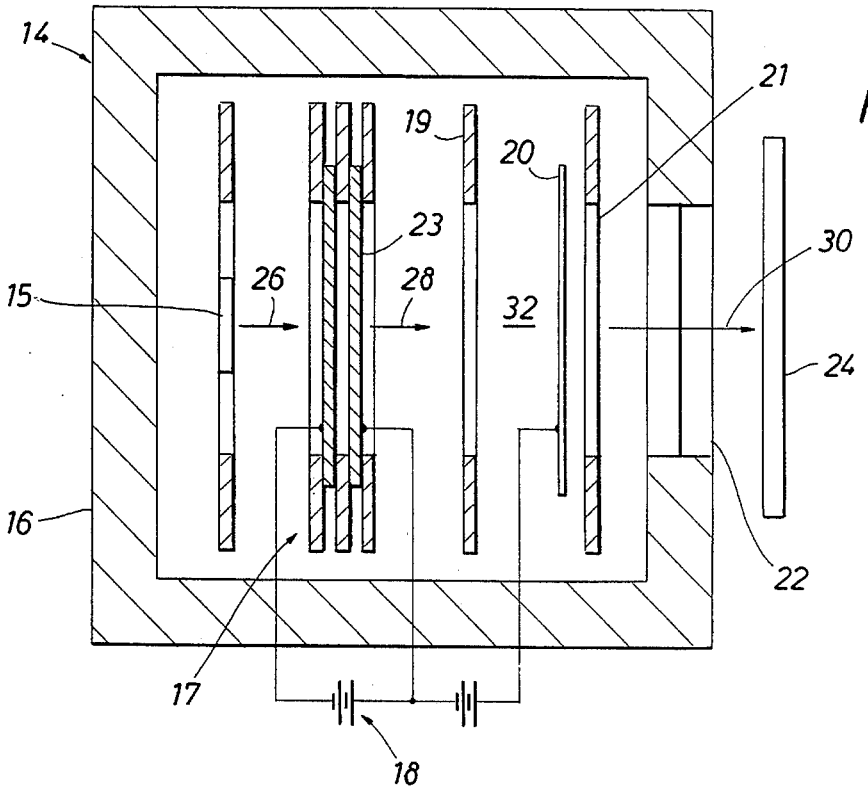
FIG. 1
FIG. 2
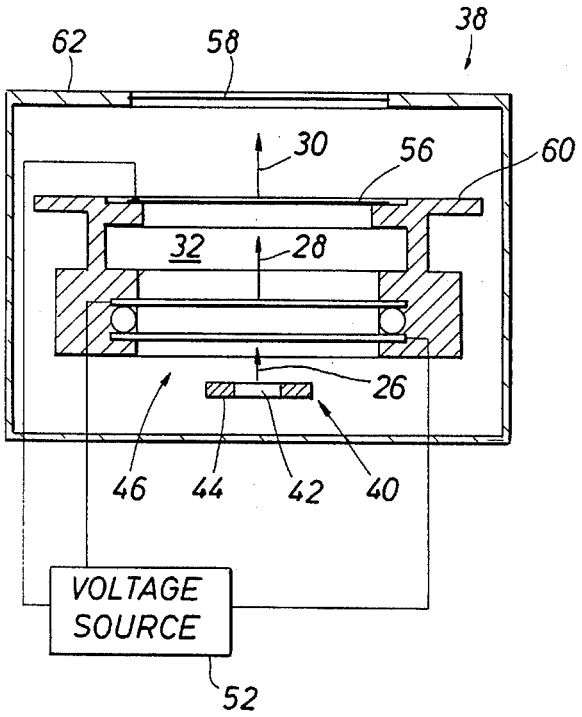
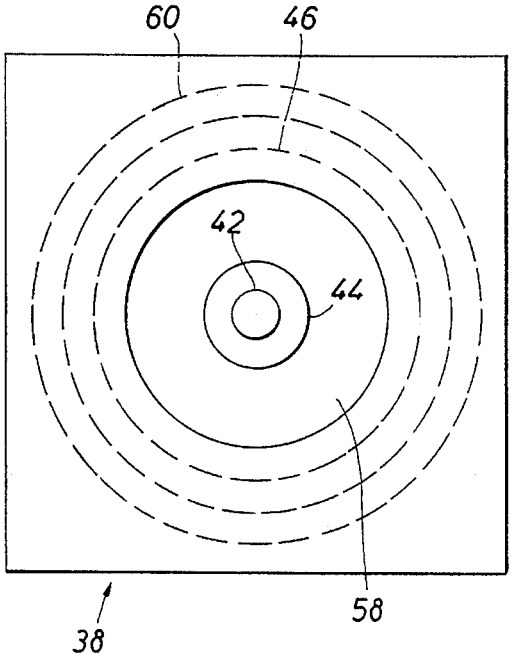
FIG. 3

METHOD AND APPARATUS FOR PRODUCING X-RAYS

FIELD OF THE INVENTION

The present invention relates in general to the field of radiation devices, and more particularly to a method and apparatus for producing x-rays.

BACKGROUND OF THE INVENTION

The use of x-rays for analyzing the physical and chemical characteristics of solids, liquids, and gases is generally known. Specific techniques utilizing x-rays include: x-ray absorptiometry, x-ray emission also called x-ray fluorescence, x-ray photoelectron spectroscopy, extended x-ray fine structure absorption spectroscopy, x-ray lithography, and x-ray microscopy. X-rays for use in these techniques may be obtained from: (a) bombardment of a solid with charged particles (electrons or ions); (b) radioactive decay (electron capture, internal conversion); or (c) high energy electrons in circular motion (synchrotron radiation).

A conventional device for producing x-rays is an x-ray tube in which a beam of electrons, each having an energy level in the range of approximately 1–10 keV, is accelerated into a metal anode. The metal anode is typically a metal foil or metal disk. The interaction of these energetic electrons with the metal anode results in the emission of photons with frequencies ranging from visible frequencies through x-ray frequencies. The energy of a photon is proportional to its frequency. The emitted photons may be classified as "bremsstrahlung" or characteristic x-rays according to their energy distribution. The photons are bremsstrahlung when they have frequencies continuously distributed across a range. Bremsstrahlung photons are generated as the electrons lose kinetic energy in the metal anode. The tube anode material, the operating voltage of the tube, and the electron current through the tube all help to determine the nature of bremsstrahlung photons generated by the x-ray tube.

In addition to bremsstrahlung x-rays, characteristic x-rays of the anode material may also be generated by the x-ray tube. These characteristic x-rays are produced at certain frequencies dependent upon the anode material because they are generated by the atomic de-excitation of the anode atoms. The output of an x-ray tube is the summation of the bremsstrahlung and characteristic x-ray distributions. The x-ray tube is a copious source of photons. However, the intense output is achieved at the cost of relative system complexity, size and mobility.

In contrast, a radioactive x-ray source is a simple device, and more compact than the x-ray tube. However, the radioactive x-ray source generally produces a less intense output than the x-ray tube. Additionally, while an x-ray tube can be turned off at will, the radioactive x-ray source cannot be turned off at will. The lack of control in the output of radioactive sources presents radiological safety problems.

Conventional x-ray tubes generally require high power in order to operate properly. This high power can be from watts to kilowatts in aggregate. Further, due to high power dissipation in the form of heat, cooling is generally required. The cooling system in the x-ray tube also adds size, weight, cost, and complexity.

Accordingly, a need has arisen for an x-ray source which is compact, but able to provide relatively high x-ray intensity.

SUMMARY OF THE INVENTION

The present invention provides a portable x-ray tube which includes a low pressure enclosure for housing an energy source, an electron multiplier and a target anode. A voltage source applies a multiplier voltage across the electron multiplier. Energetic particles or photons, created by the energy source, trigger the electron multiplier. The particles or photons can be created in temporal pulses and the temporal pulses can be produced at a specified repetition rate. The electron multiplier, when triggered, creates an electron avalanche "EA") directed towards the target anode which receives the electrons and produces x-rays. The EA retains the temporal characteristics of the pulses created by the energy source. The target anode has a voltage difference greater than 3 kV with respect to a proximate portion of the electron multiplier to define an electron acceleration region between the proximate portion of the electron multiplier and the target anode. The target anode includes a chemical element having an atomic number greater than 11. The enclosure includes a window that allows the x-rays to exit the enclosure.

An alternate embodiment of the present invention provides a portable x-ray tube which includes a low pressure enclosure for housing an electron multiplier and a target anode. A voltage source applies a high multiplier voltage across the electron multiplier. The electron multiplier, when connected to the high multiplier voltage, spontaneously creates an electron avalanche directed towards the target anode which receives the electrons and produces x-rays. The target anode has a voltage difference greater than 3 kV with respect to a proximate portion of the electron multiplier to define an electron acceleration region between the proximate portion of the electron multiplier and the target anode. The target anode includes a chemical element having an atomic number greater than 11. The enclosure includes a window that allows the x-rays to exit the enclosure.

In another feature of the present invention, the target anode in either of the above discussed embodiments can be replaced by an acceleration anode and a target. The acceleration anode has a voltage difference greater than 3 kV with respect to a proximate portion of the electron multiplier to define an electron acceleration region between the proximate portion of the electron multiplier and the acceleration anode. The electron avalanche is directed toward the target which receives the electrons and produces x-rays. The target includes a chemical element having an atomic number greater than 11.

In another feature of the present invention, the energy source, the electron multiplier, and the target anode are collinear. In another feature of the present invention, the energy source is a device selected from the group consisting of a radioactive source, a photon emitter, an electron gun, and an electric field emitter. In another feature of the present invention, the electron multiplier is a device selected from the group consisting of a continuous dynode electron multiplier, a discrete dynode electron multiplier, a microchannel plate, a grid multiplier, and a channel electron multiplier.

The present invention provides a method of producing x-rays which includes producing an electron avalanche with a electron multiplier and accelerating the electrons across a region of greater than 3 kV potential difference. The electrons are collided with a target that has an element with an atomic number greater than 11 such that x-rays are produced. A portion of the x-rays follow a path. The target and electron multiplier are enclosed in a low pressure enclosure having a window. The window is positioned in the path.

The present invention provides an electron avalanche portable x-ray tube which is compact, intense, light weight, and which provides either pulsed or continuous output x-rays with relatively low power consumption and a method of the portable x-ray tube's operation.

BRIEF DESCRIPTION OF THE DRAWINGS

The above-noted and other aspects of the present invention will become more apparent from a description of the preferred embodiment when read in conjunction with the accompanying drawings. The drawings illustrate the preferred embodiment of the invention. In the drawings the same members have the same reference numerals.

FIG. 1 depicts an x-ray source including an acceleration anode constructed according to the present invention.

FIG. 2 depicts a top view of an x-ray source including a target anode constructed according to the present invention.

FIG. 3 depicts a front view of the x-ray source in FIG. 2.

DETAILED DESCRIPTION OF THE PREFERRED EMBODIMENT

Figure 4:
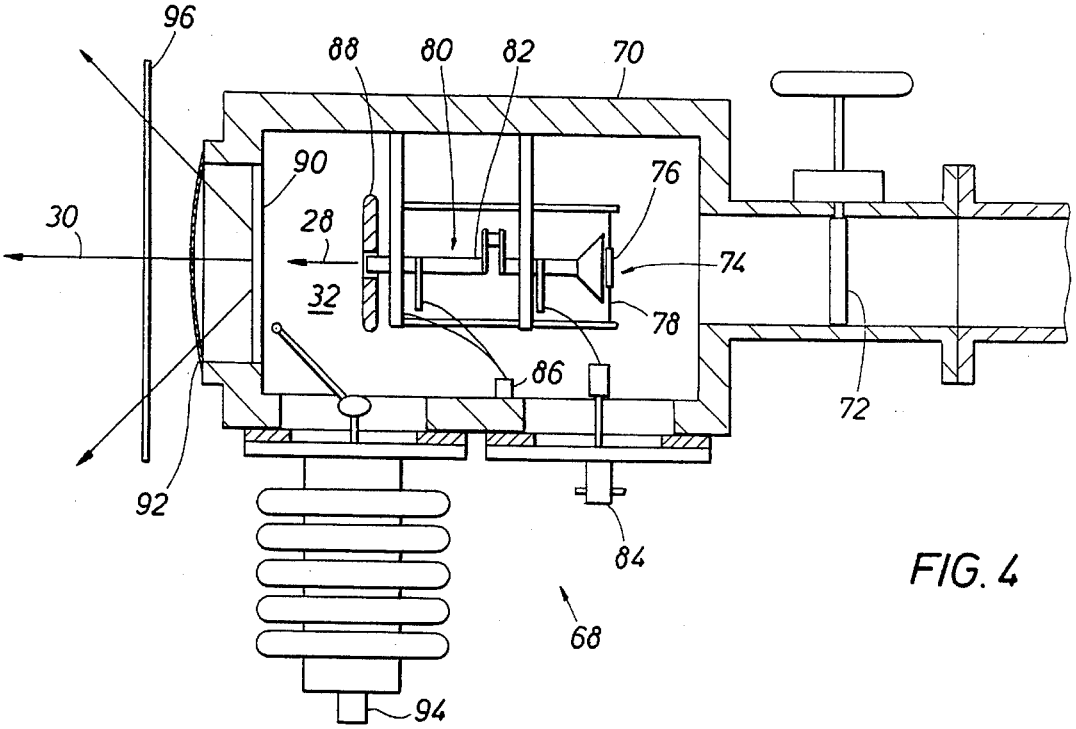
FIG. 4 depicts the preferred embodiment of the present invention, wherein a channel electron multiplier and a radioactive source are used to produce pulsed x-rays.

FIG. 1 depicts an x-ray source including an acceleration anode constructed according to the present invention. A portable x-ray tube 14 includes a low pressure enclosure 16, a energy source 15, a electron multiplier 17, a voltage source 18, an acceleration anode 20, a target 21, a window 22, an electron focusing apparatus 19, and a filter 24. The electron multiplier 17 has a portion 23 proximate the acceleration anode 20. The portion 23 and the acceleration anode 20 define between them an electron acceleration region 32.

The energy source 15 is an alpha ($\alpha$) particle radioactive source ($^{230}$Th, half life 80,000 years, activity 0.1 $\mu$Ci). The voltage source 18 applies a multiplier voltage across the electron multiplier 17. The voltage source 18 can apply a high multiplier voltage across the electron multiplier 17. The multiplier voltage is 2 kV. The multiplier voltage is high enough to activate an electron multiplier when it is triggered by an energy source. The high multiplier is 3 kV. The high multiplier voltage is a high enough to trigger an electron multiplier spontaneously.

The filter 24 is disposed outside the window 22. The filter 24 selectively interferes with the transmission of energetic photons. The window 22 is an x-ray permeable substance that allows x-rays of a range of frequencies to pass through substantially without interference. The acceleration anode 20 is at 30 kV greater electrical potential than the portion 23. The 30 kV electrical potential difference can be modified to as low as 3 kV or as high as can be sustained by an available power supply.

The portable x-ray tube 14 operates as follows. The energy source 15 produces energetic particles 26 directed toward the electron multiplier 17. The energy source 15 is capable of producing pulses of energetic particles 26, the pulses having small temporal length. These pulses can be produced at a specified repetition rate corresponding to the frequency at which the energy source 15 is activated. The electron multiplier 17 generates a multitude of energetic electrons 28, i.e., an electron avalanche, in response to the energetic particles 26 from the energy source 15. When the energy source 15 produces temporally constrained pulses at the specified repetition rate, the electron multiplier 17 generates temporally constrained electron avalanches at the specified repetition rate.

Each electron avalanche is directed by the electron focusing assembly 19 through the electron acceleration region 32. As the electrons exit the electron multiplier 17, each has an energy of approximately a few tens of eV. The electrons in each electron avalanche gain 30 keV of energy as they traverse the electron acceleration region 32. Each electron avalanche passes through the acceleration anode 20 and collides with a side of the target 21, causing emission of bremsstrahlung and characteristic x-rays 30 from the second side of the target 21. The target 21 is a copper foil. The portable x-ray tube 14 operates in a transmission mode because the x-rays 30 are emitted from the opposite side of the target 21 from the electron collision. A portion of the x-rays 30 follow a path away from the second side of the target 21. The path exits the low pressure enclosure 16 through the window 22. Electron avalanches that are temporally constrained at the specified repetition rate cause the x-rays 30 to be emitted in temporally constrained pulses at the specified repetition rate.

The low pressure enclosure 16 is airtight with a pressure low enough to operate the electron multiplier 17, a pressure of less than $10^{-4}$ torr The energy source 15, the electron multiplier 17, and the target 21 are disposed collinearly within the low pressure enclosure 16.

The energy source 15 can be replaced by a device selected from a group consisting of an electric field emitter, an electron gun, a photon emitter, and a filament. One electric filed emitter is a metallic grid at room temperature and under an electrical field greater than a few kV/cm. The grid emits thousands of electrons per cm$^2$ under the above conditions. This grid provides a source of electrons with energies of 1–10 kV. The grid's electron emission process is random, but occurs at a fairly constant rate. This rate is varied through several orders of magnitude by changing the bias of the grid. Field emission of electrons is a relatively simple and inexpensive way to produce electrons with energies of 1–10 kV.

An electron gun can produce a narrow and very weak electron beam in a static or sweeping mode. The beam can be pulsed to produce an intense pulsed energy source. The frequency of the pulses produced by an electron gun can be changed externally by a low voltage pulse generator.

One photon emitter is a light emitting diode (LED). An LED is a small, inexpensive, and simple photon source that can be used with a suitable photocathode converter. The output of an LED can be controlled by adjusting the bias of the LED. In addition, the LED can be controlled by feedback.

The electron multiplier 17 can be replaced by a device selected from the group consisting of a microchannel plate, a channel electron multiplier, a continuous dynode electron multiplier, a discrete dynode multiplier and a grid multiplier. Microchannel plates are devices in which a very fast multiplication of electrons is obtained in a small region called a channel. Each plate comprises a plurality of channels, for example on the order of about $10^4$ to $10^7$, which are parallel to one another. Each channel is about 1 mm long and 10–20/xm in diameter, for example. Electrons are directed at the entry face of the plate and enter one of the many channels. For each electron that enters one of the channels of the plate, a multitude of electrons is output at the opposite or exit face of the plate.

For an applied bias between the faces on the order of 1 kV the multiplication factor is approximately $10^3$. Two 1 kV biased microchannel plates arranged in series have a multiplication factor of approximately $10^6$ to $10^9$. This multiplication of electrons takes place is a few nanoseconds. This large volume of electrons is called an "electron avalanche."

A continuous dynode electron multiplier (CDEM) is made by Detector Technology, Inc. (DeTech) under the name EverLast CDEM or Segmented CDEM.

A channel electron multiplier is a nonmagnetic device which is formed from a special formulation of heavily lead-doped glass. A voltage source is supplied at opposite ends of the channel to allow the wall of the channel electron multiplier to replenish its charge and to accelerate the electrons inside the channel electron multiplier. Galileo Electro-Optics Corporations makes a version of this device under the trademark Channeltron.

FIG. 2 depicts a top view of an x-ray source including a target anode constructed according to the present invention. A portable x-ray tube 38 includes a low pressure enclosure 62 and an assembly holder 60. The low pressure enclosure 62 has a window 58. The assembly holder 60 retains the electron multiplier 46 and the target anode 56. The assembly holder 60 is encompassed by the low pressure enclosure 62. A energy source 40 is also inside the low pressure enclosure 62. The energy source 40 includes a radioactive source 42 and a radioactive source holder 44. A voltage source 52 provides an electrical potential of 2 kV across the electron multiplier 46. The voltage source 52 provides an electrical potential of 30 kV to the target anode 56 relative to a portion of the electron multiplier 46 proximate the target anode 56. An electron acceleration region 32 is defined between the proximate portion of the electron multiplier 46 and the target anode 56.

The portable x-ray tube 38 operates as follows. The energy source 40 produces energetic particles 26 directed toward the electron multiplier 46. The electron multiplier 46 generates a multitude of energetic electrons 28, i.e., an electron avalanche, in response to the energetic particles 26 from the energy source 40.

Each electron avalanche is directed through the electron acceleration region 32. As the electrons exit the electron multiplier 46, each has an energy of approximately a few tens of eV. The electrons in each electron avalanche gain 30 keV of energy as they traverse the electron acceleration region 32. Each electron avalanche collides with a first side of the target anode 56, causing emission of bremsstrahlung and characteristic x-rays 30 from the second side of the target anode 56. The frequency characteristics of the emitted x-rays 30 make up an x-ray spectrum. The intensity and shape of the x-ray spectrum depends on both the energy of the electrons which are impacted and the atomic number (Z) of the target anode 56 where the impact occurs. The target anode 56 must include an element with an atomic number greater than 11 to produce x-rays. Total x-ray yield increases greatly when the electron energy increases in the tens of keV range. In addition, while the characteristic radiation is emitted isotopically, the bremsstrahlung is anisotropic and is not emitted forward by this range of electron energies. The portable x-ray tube 38 operates in the transmission mode. A portion of the x-rays 30 follow a path away from the second side of the target anode 56. The path exits the low pressure enclosure 62 through the window 58.

FIG. 3 depicts a front view of the x-ray source in FIG. 2. The shapes of the radioactive source 42, radioactive source holder 44, and window 58 are illustrated.

FIG. 4 depicts the preferred embodiment of the present invention, wherein a channel electron multiplier and a radioactive source are used to produce pulsed x-rays. A portable x-ray tube 68 includes a low pressure enclosure 70, a pressure valve 72, a energy source 74, a electron multiplier 80, a target anode 90, and a filter 96. The low pressure enclosure 70 has a window 92. The pressure valve 72 can open and close so that the pressure in the low pressure enclosure 70 can be adjusted.

The energy source 74 includes an alpha source 76 and an alpha source holder 78. The alpha source 76 includes $^{230}$Th which has a half life of 80,000 years and 0.1 μCi activity. The alpha source 76 is coupled to a control switch 116. The control switch has a first position and a second position. When the control switch 116 is in the first position, the alpha source 76 is activated at a constant level. A frequency generator 114 is coupled to the control switch 116. Frequency generators are well known in the art. The frequency generator 114 includes controls for determining its output frequency as is well known in the art. When the control switch 116 is in the second position, the frequency generator 114 activates the alpha source 76 at a repetition rate corresponding to the controls.

The electron multiplier 80 includes a channel electron multiplier 82 that is made by Galileo Electro-Optics Corporation under the name Channeltron™. The electron multiplier 80 also includes an electrode ring 88 that is coupled to the ground terminal 86. The channel electron multiplier 82 is connected proximate a first end to a voltage source 84. The voltage source 84 has a voltage of −2.5 kV. The channel electron multiplier 82 is connected at a second end to the ground terminal 86.

The target anode 90 is a thin copper foil and during operation is connected to a target anode voltage source 94. The target anode voltage source 94 is biased at 50 kV of electrical potential relative to the ground terminal 86. The window 92 is made of Be or another material that allows x-rays of a range of frequencies to pass through substantially without interference.

Figure 5:
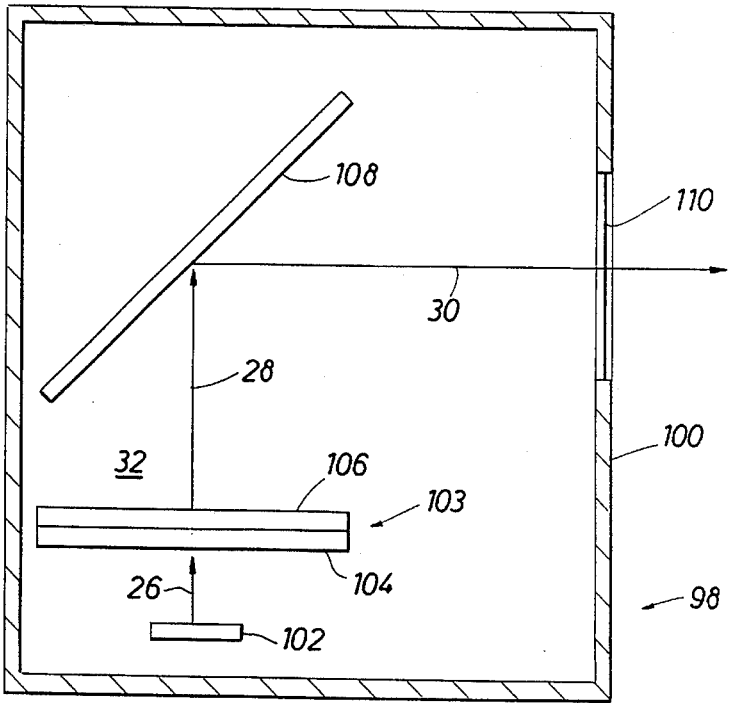
FIG. 5 depicts an x-ray source operating in reflection mode constructed according to the present invention.

FIG. 5 depicts an x-ray source operating in reflection mode constructed according to the present invention. A portable x-ray tube 98 includes a low pressure enclosure 100, a energy source 102, a electron multiplier 103, and a target anode 108. The low pressure enclosure 100 has a window 110. The electron multiplier 103 includes microchannel plates 104, 106.

The portable x-ray tube 98 operates in a reflection mode because the target anode 108 is thicker than a foil. The energetic electrons 28 collide with a first side of the target anode 108 and the first side emits x-rays 30. A portion of the x-rays 30 follow a path through the window 110.

Figure 6A:
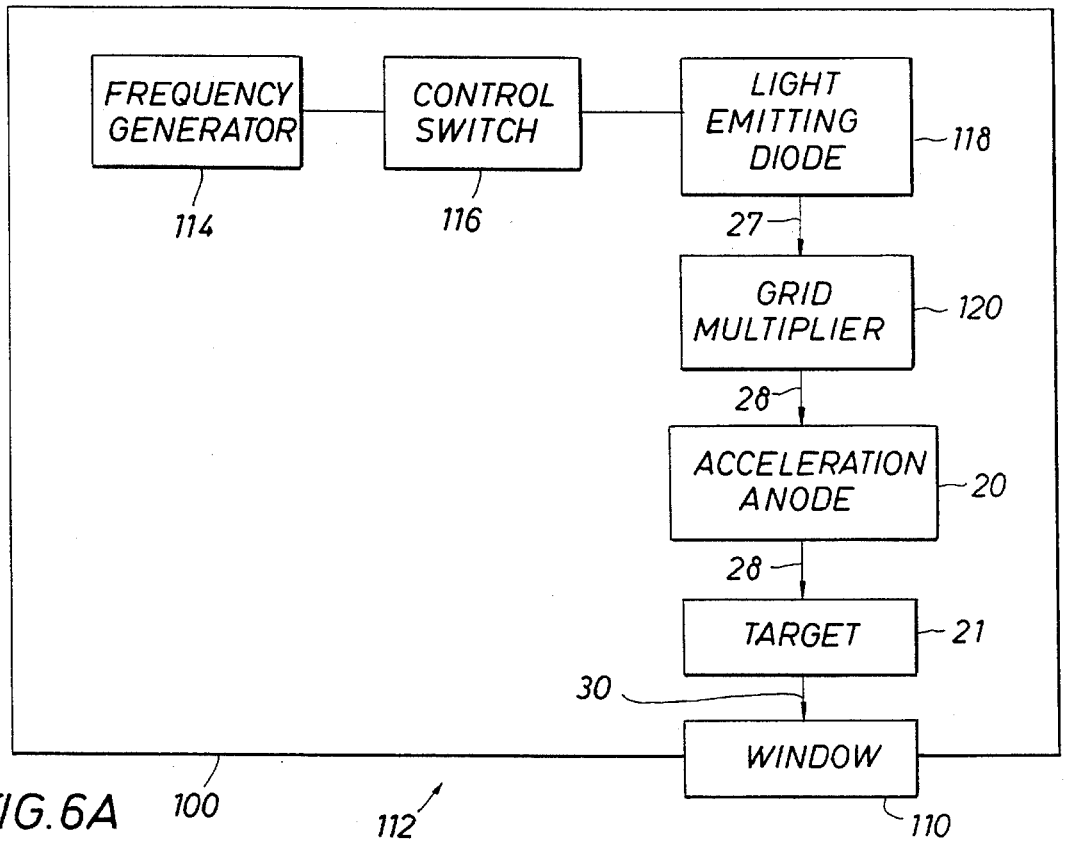
FIG. 6A depicts a schematic representation of a pulsed x-ray source including an acceleration anode constructed according to the present invention.

FIG. 6A depicts a schematic representation of a pulsed x-ray source including an acceleration anode constructed according to the present invention. A portable x-ray 112 tube includes the low pressure enclosure 100, a light emitting diode 118, a grid multiplier 120, the acceleration anode 20, and the target 21. The low pressure enclosure 100 includes the window 110.

The light emitting diode 118 is coupled to the control switch 116. When the control switch 116 is in the first position, the light emitting diode 118 is activated at a constant level. The frequency generator 114 is coupled to the control switch 116. Frequency generators are well known in the art. The frequency generator 114 includes controls for determining its output frequency as is well known in the art. When the control switch 116 is in the second position, the frequency generator 114 activates the light emitting diode 118 at a repetition rate corresponding to the controls.

The light emitting diode 118 emits photons 27 in the direction of the grid multiplier 120. The photons 27 collide with a first portion of the grid multiplier 120 proximate the light emitting diode 118 and create energetic electrons 28 at a second portion of the grid multiplier 120 proximate the acceleration anode 20. The acceleration anode 20 is at an electrical potential 40 kV higher than the second portion of the grid multiplier 120. The energetic electrons 28 gain energy and collide with the first side of the target 21. X-rays 30 are emitted from the second side of the target 21. A portion of the x-rays 30 follow a path through the window 110.

Figure 6B:
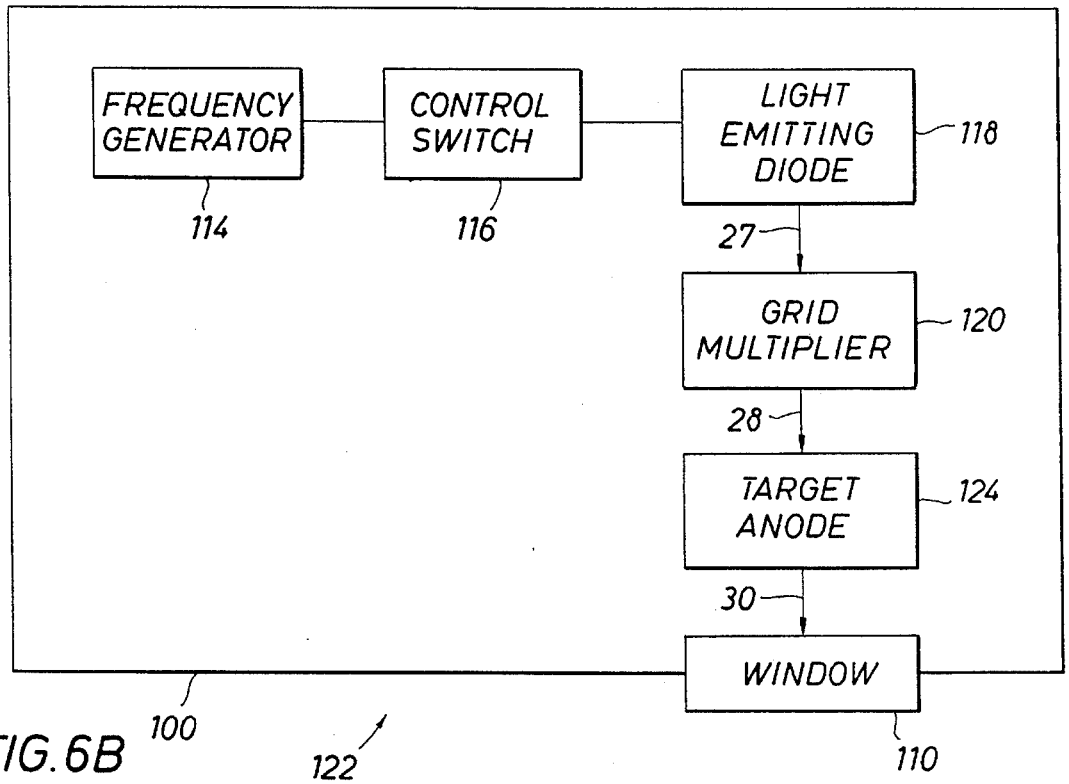
FIG. 6B depicts a schematic representation of a pulsed x-ray source including a target anode constructed according to the present invention.

FIG. 6B depicts a schematic representation of a pulsed x-ray source including a target anode constructed according to the present invention. A portable x-ray 122 tube includes the low pressure enclosure 100, the light emitting diode 118, the grid multiplier 120, and a target anode 124. The low pressure enclosure 100 includes the window 110.

The light emitting diode 118 is coupled to the control switch 116. When the control switch 116 is in the first position, the light emitting diode 118 is activated at a constant level. The frequency generator 114 is coupled to the control switch 116. Frequency generators are well known in the art. The frequency generator 114 includes controls for determining its output frequency as is well known in the art. When the control switch 116 is in the second position, the frequency generator 114 activates the light emitting diode 118 at a repetition rate corresponding to the controls.

The light emitting diode 118 emits photons 27 in the direction of the grid multiplier 120. The photons 27 collide with the first portion of the grid multiplier 120 proximate the light emitting diode 118 and create energetic electrons 28 at the second portion of the grid multiplier 120 proximate the target anode 124. The target anode 124 is at an electrical potential 40 kV higher than the second portion of the grid multiplier 120. The energetic electrons 28 gain energy and collide with a first side of the target anode 124. X-rays 30 are emitted from a second side of the target anode 124. A portion of the x-rays 30 follow a path through the window 110.

Figure 7:
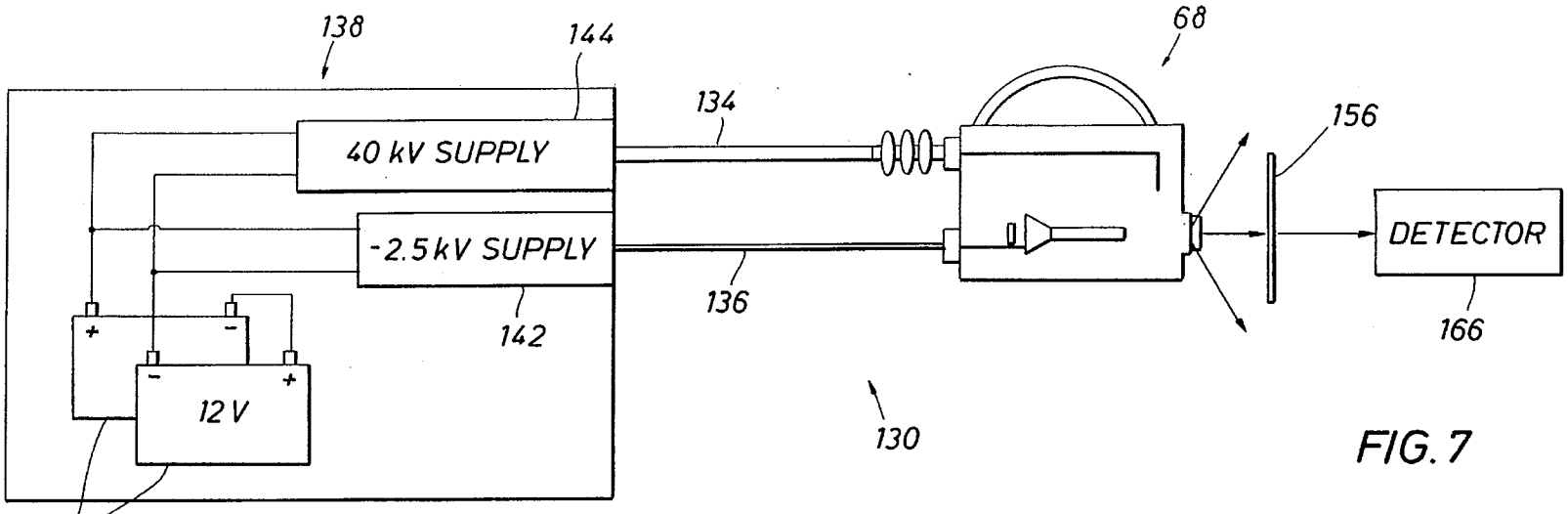
FIG. 7 depicts a portable system of conducting x-ray analysis constructed according to the present invention.

FIG. 7 depicts a portable system of conducting x-ray analysis constructed according to the present invention. A portable system for producing x-rays 130 includes a voltage supply assembly 138, the portable x-ray tube 68, a voltage line 134, a voltage line 136, a sample 156 and a detector 166.

The voltage supply assembly 138 includes two 12 volt batteries 140. The 12 volt batteries 140 are serially connected. The voltage supply assembly 138 also includes a voltage source 142 and a voltage source 144. The voltage source 142 has a voltage level of −2.5 kV. The voltage source 144 has a voltage level of 40 kV.

The voltage line 134 couples the voltage source 144 to the portable x-ray tube 68. The voltage line 136 couples the voltage source 142 to the portable x-ray tube 68. The sample 156 is a biological tissue sample. The detector 166 is a gas proportional counter as is well known in the art.

Figure 8:
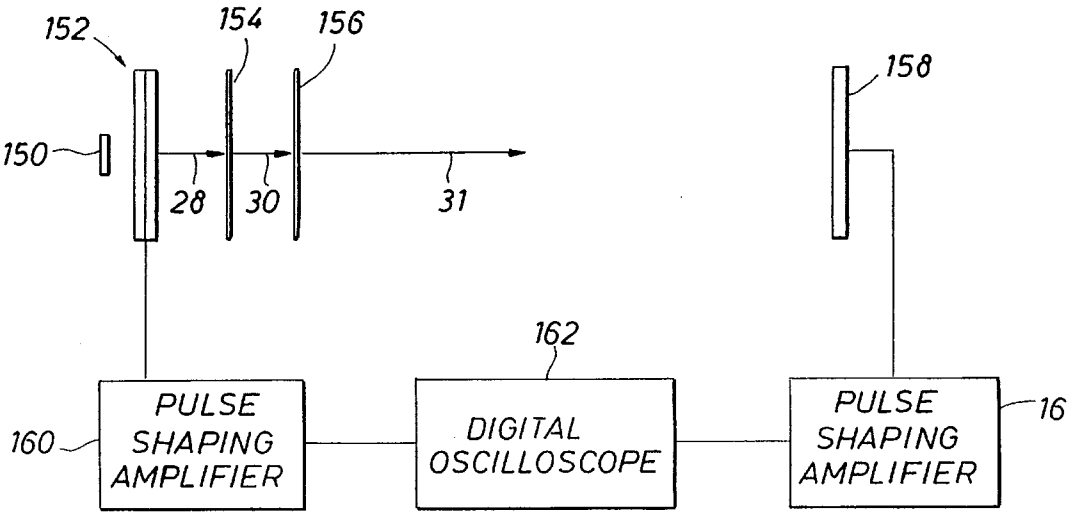
FIG. 8 depicts a pulsed x-ray time system constructed according to the present invention in a time of flight analysis system.

FIG. 8 depicts a pulsed x-ray time system constructed according to the present invention in a time of flight analysis system. A energy source 150, a electron multiplier 152 and a target anode 154 operate to produce x-rays 30 in the transmission mode. A portion of the x-rays 30 collide with a first side of the sample 156. Energetic sample particles 31 are emitted from a second side of the sample 156 as a result of the x-ray collisions. A portion of the energetic sample particles 31 collide with a stop detector 158.

The electron multiplier 152 is coupled to a pulse shaping amplifier 160. The pulse shaping amplifier 160 detects the beginning of the electron avalanche produced by the electron multiplier 152 in response to the energy source 150. The stop detector 158 is coupled to a pulse shaping amplifier 161. The pulse shaping amplifier 161 detects the collision of energetic sample particles 31 with the stop detector 158. The pulse shaping amplifiers 160, 161 are coupled to a digital oscilloscope 162. The digital oscilloscope 162 determines time measurements corresponding to the detections made by the pulse shaping amplifiers 160, 161. The difference in the time measurements is used to analyze the sample 156.

Figure 9:
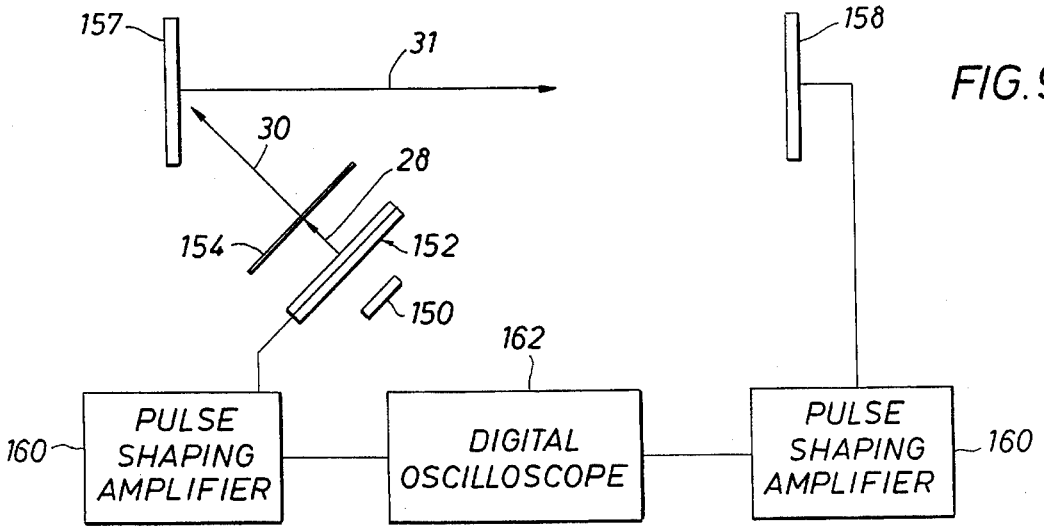
FIG. 9 depicts an x-ray time analysis system operating in reflection mode constructed according to the present invention for photon stimulated desorption.

FIG. 9 depicts an x-ray time analysis system operating in reflection mode constructed according to the present invention for photon stimulated desorption. A energy source 150, a electron multiplier 152 and a target anode 154 operate to produce x-rays 30 in the transmission mode. A portion of the x-rays 30 collide with a first side of the sample 157. Energetic sample particles 31 are emitted from the first side of the sample 157 as a result of the x-ray collisions. A portion of the energetic sample particles 31 collide with a stop detector 158.

The electron multiplier 152 is coupled to a pulse shaping amplifier 160. The pulse shaping amplifier 160 detects the beginning of the electron avalanche produced by the electron multiplier 152 in response to the energy source 150. The stop detector 158 is coupled to a pulse shaping amplifier 161. The pulse shaping amplifier 161 detects the collision of energetic sample particles 31 with the stop detector 158. The pulse shaping amplifiers 160, 161 are coupled to a digital oscilloscope 162. The digital oscilloscope 162 determines time measurements corresponding to the detections made by the pulse shaping amplifiers 160, 161. The difference in the time measurements is used to analyze the sample 156.

Figure 10:
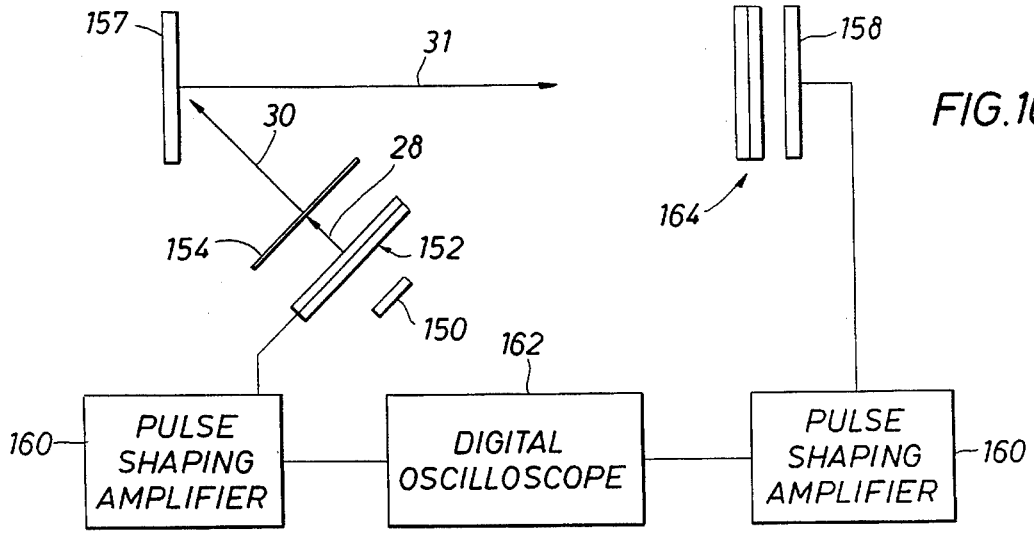
FIG. 10 depicts an x-ray time analysis system operating in reflection mode including a detection amplifier constructed according to the present invention.

FIG. 10 depicts an x-ray time analysis system operating in reflection mode including a detection amplifier constructed according to the present invention. The elements of FIG. 9 are supplemented to include a detection amplifier 164 that receives the energetic sample particles 31 and amplifies the signal for the stop detector 158. The detection amplifier has two microchannel plates. The other elements work in accordance with the discussion of FIG. 9.

Figure 11:
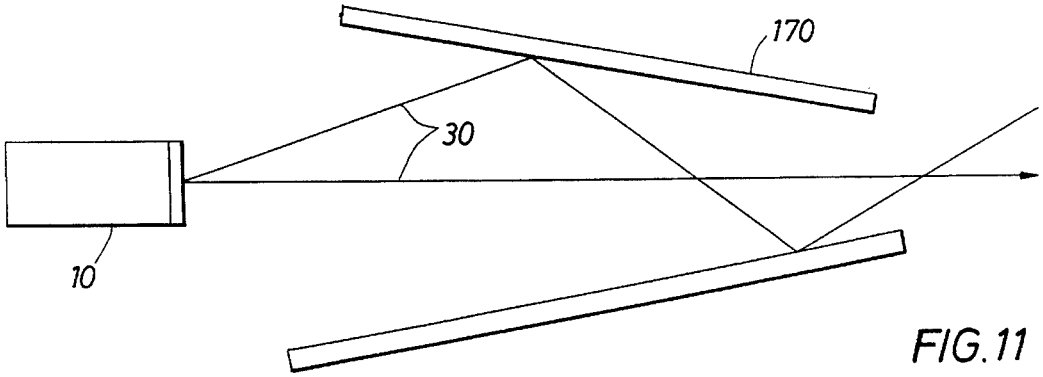
FIG. 11 depicts a focussed x-ray source constructed according to the present invention.

FIG. 11 depicts a focussed x-ray source constructed according to the present invention. The portable x-ray source 10, depicted in FIG. 1, is positioned so that the path of the x-rays 30 enters a focussing capillary 170. The electron focussing assembly 18 (see FIG. 1) collimates the energetic electrons 28 onto a point of the target 20 such that the x-rays 30 are produced from one point. The x-rays 30 exit the focussing capillary 170 as a x-ray microbeam.

Figure 12:
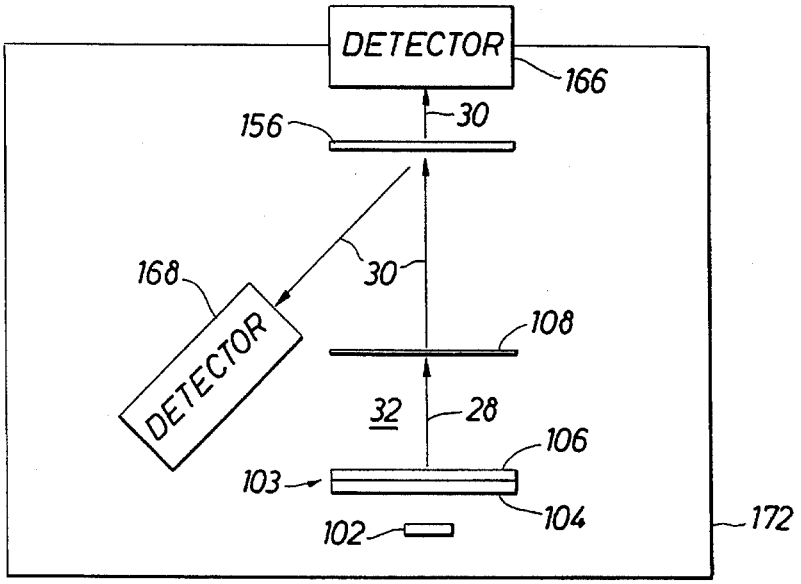
FIG. 12 depicts an x-ray analysis system with an internal detector constructed according to the present invention.

FIG. 12 depicts an x-ray analysis system with an internal detector constructed according to the present invention. The energy source 102, the electron multiplier 103, the target anode 108, the sample 156, and an x-ray detector 168 are positioned within a low pressure enclosure 172. The low pressure enclosure 172 includes the detector 166. The x-ray detector 168 is a gas proportional counter.

The energy source 102, the electron multiplier 103, and the target anode 108 produce x-rays 30 in the transmission mode as discussed above (see FIG. 5). The x-rays 30 collide with the first side of the sample 156. A portion of the x-rays are reflected from the first side of the sample 156 along a path that intercepts the x-ray detector 168. X-rays 30 are emitted from the second side of the sample 156 by the x-ray collisions. A portion of the x-rays 30 follow a path that intercepts the detector 166. This system employs x-ray fluorescence to analyze the sample 156. X-ray fluorescence is the emission by a substance of its characteristic x-ray line spectrum upon exposure to x-rays.

Figure 13:
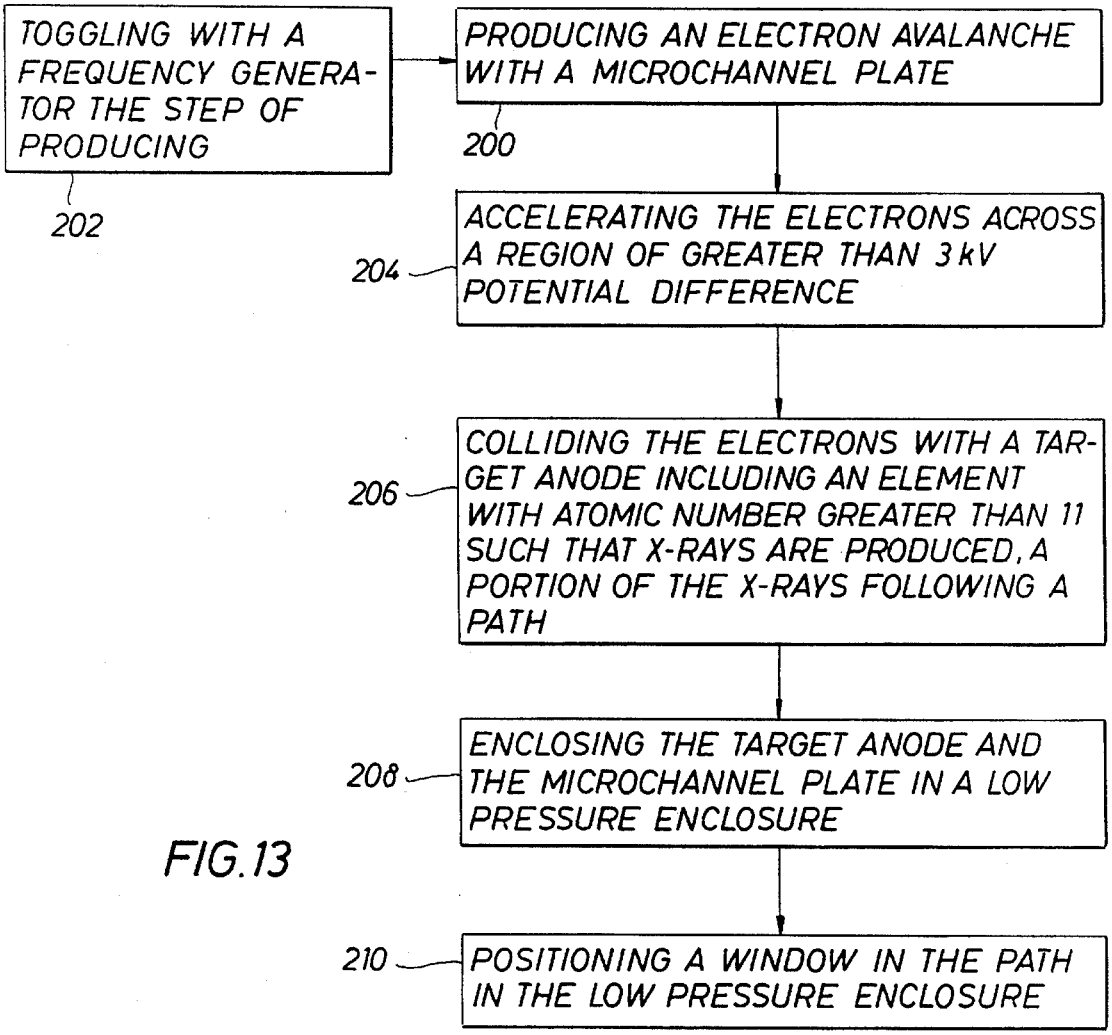
FIG. 13 depicts a schematic representation of a method for producing x-rays in accordance with the present invention.

FIG. 13 depicts a schematic representation of a method for producing x-rays in accordance with the present invention. In step 200, an electron avalanche is produced with a microchannel plate. In step 202, the step of producing is toggled with a frequency generator. In step 204, the electrons are accelerated across a region of greater than 3 kV potential difference. In step 206, the electrons are collided with a target anode that includes an element with atomic number greater than 11 such that x-rays are produced, a portion of the x-rays following a path. In step 208, the target anode and the microchannel plate are enclosed in a low pressure enclosure having a window. In step 210, the window is positioned in the path.

The present invention provides a method and apparatus for producing x-rays that has the benefit of being compact, intense, light weight, and which provides either pulsed or continuous output x-rays with the benefit of low power consumption relative to conventional x-ray producing devices.

The principles, preferred embodiment, and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit and scope of the invention as defined by the appended claims.

We claim:

1. A portable x-ray tube for producing x-rays, comprising:

an electron multiplier for producing electrons;

a voltage source coupled to electron multiplier for applying a multiplier voltage across the electron multiplier;

a target anode positioned for receiving electrons produced by the electron multiplier and for producing x-rays, the target anode having a voltage difference of greater than 3 kV with respect to a proximate portion of the electron multiplier, the target anode comprising an element having an atomic number greater than 11;

the target anode and the electron multiplier defining an electron acceleration region between the target anode and the electron multiplier;

a portion of the x-rays following a path from the target anode;

a low pressure enclosure containing the electron multiplier and the target anode; and a window in the low pressure enclosure, the window positioned in the path.

2. The portable x-ray tube of claim 1, wherein the multiplier voltage is a high multiplier voltage.

3. The portable x-ray tube of claim 1, further comprising:

an energy source;

and wherein the electron multiplier is coupled to the energy source.

4. The portable x-ray tube of claim 1, further comprising:

an electron focusing assembly disposed within the electron acceleration region.

5. The portable x-ray tube of claim 1, wherein the target anode has a voltage difference of greater than 5 kV with respect to the proximate portion of the electron multiplier.

6. The portable x-ray tube of claim 1, wherein the target anode has a voltage difference of greater than 20 kV with respect to the proximate portion of the electron multiplier.

7. The portable x-ray tube of claim 1, wherein the pressure within the low pressure enclosure is less than $10^{-4}$ torr.

8. The portable x-ray tube of claim 1, wherein the electron multiplier comprises a device selected from the group consisting of a continuous dynode electron multiplier, a discrete dynode electron multiplier, a microchannel plate, a grid multiplier and a channel electron multiplier.

9. The portable x-ray tube of claim 1, wherein the target anode comprises a foil.

10. The portable x-ray tube of claim 3, wherein the energy source comprises a device selected from the group consisting of a radioactive source, a photon emitter, an electron gun, and an electric field emitter.

11. The portable x-ray tube of claim 10, wherein the energy source is a photon emitter and the photon emitter is a light emitting diode.

12. The portable x-ray tube of claim 3, further comprising a frequency generator coupled to the energy source, the frequency generator having controls, the frequency generator activating the energy source for short time periods at a repetition rate corresponding to the controls.

13. The portable x-ray tube of claim 3, further comprising:

a control switch coupled to the energy source, the control switch having first and second positions, the control switch activating the energy source at a constant level when in the first position;

a frequency generator coupled to the control switch, the frequency generator having controls, the frequency generator activating the energy source for short time periods at a repetition rate corresponding to the controls when the control switch is in the second position.

14. A portable x-ray tube for producing x-rays, comprising:

an electron multiplier for producing electrons;

a voltage source coupled to electron multiplier for applying a multiplier voltage across the electron multiplier;

an acceleration anode having a voltage difference of greater than 3 kV with respect to a proximate portion of the electron multiplier, the acceleration anode allowing passage of the electrons;

the acceleration anode and the electron multiplier defining an electron acceleration region between the acceleration anode and the electron multiplier;

a target positioned for receiving electrons which pass through the acceleration anode and for producing x-rays, the target comprising an element having an atomic number greater than 11;

a portion of the x-rays following a path from the target;

a low pressure enclosure containing the electron multiplier and the acceleration anode; and a window in the low pressure enclosure, the window positioned across the path.

15. The portable x-ray tube of claim 14, wherein the multiplier voltage is a high multiplier voltage.

16. The portable x-ray tube of claim 14, further comprising:

an energy source;

and wherein the electron multiplier is coupled to the energy source.

17. The portable x-ray tube of claim 14, further comprising:

an electron focusing assembly disposed within the electron acceleration region.

18. The portable x-ray tube of claim 14, wherein the acceleration anode has a voltage difference of greater than 5 kV with respect to the proximate portion of the electron multiplier.

19. The portable x-ray tube of claim 14, wherein the acceleration anode has a voltage difference of greater than 20 kV with respect to the proximate portion of the electron multiplier.

20. The portable x-ray tube of claim 14, wherein the pressure within the low pressure enclosure is less than $10^{-4}$ torr.

21. The portable x-ray tube of claim 14, wherein the electron multiplier comprises a device selected from the group consisting of a continuous dynode electron multiplier, a discrete dynode electron multiplier, a microchannel plate, a grid multiplier and a channel electron multiplier.

22. The portable x-ray tube of claim 16, wherein the energy source comprises a device selected from the group consisting of a radioactive source, a photon emitter, an electron gun, and an electric field emitter.

23. The portable x-ray tube of claim 22, wherein the energy source is a photon emitter and the photon emitter is a light emitting diode.

24. The portable x-ray tube of claim 16, further comprising a frequency generator coupled to the energy source, the frequency generator having controls, the frequency generator activating the energy source for short time periods at a repetition rate corresponding to the controls.

25. The portable x-ray tube of claim 16, further comprising:

a control switch coupled to the energy source, the control switch having first and second positions, the control switch activating the energy source at a constant level when in the first position;

a frequency generator coupled to the control switch, the frequency generator having controls, the frequency generator activating the energy source for short time periods at a repetition rate corresponding to the controls when the control switch is in the second position.

26. A system for x-ray analysis of a sample, comprising:

an electron multiplier for producing electrons;

a voltage source coupled to electron multiplier for applying a multiplier voltage across the electron multiplier;

a target anode positioned for receiving electrons produced by the electron multiplier and for producing x-rays, the target anode having a voltage difference of greater than 3 kV with respect to a proximate portion of the electron multiplier, the target anode comprising an element having an atomic number greater than 11;

the target anode and the electron multiplier defining an electron acceleration region between the target anode and the electron multiplier;

a low pressure enclosure containing the electron multiplier and the target anode; and an x-ray detector within the low pressure enclosure.

27. The system of claim 26 wherein the x-ray detector, the electron multiplier, and the target anode are collinear.

28. A method of producing x-rays comprising the steps of:

producing an electron avalanche with an electron multiplier, the electron avalanche having electrons;

accelerating the electrons across a region of greater than 3 kV potential difference;

colliding the electrons with a target comprising an element with atomic number greater than 11 such that x-rays are produced, a portion of the x-rays following a path;

enclosing the target and the electron multiplier in a low pressure enclosure having a window; and positioning the window in the path.

29. The method of claim 28 wherein the target comprises a target anode.

30. The method of claim 28 further comprising the step of toggling with a frequency generator the step of producing.

31. The method of claim 28 wherein the electron multiplier comprises a microchannel plate.

32. A portable system for x-ray analysis of a sample comprising:

an energy source;

an electron multiplier coupled to the energy source, the electron multiplier for producing electrons;

a target anode positioned for receiving electrons produced by the electron multiplier and for producing x-rays, the target anode having a voltage difference of greater than 3 kV with respect to a proximate portion of the electron multiplier, the target anode comprising an element having an atomic number greater than 11;

the target anode and the electron multiplier defining an electron acceleration region between the target anode and the electron multiplier;

a portion of the x-rays following a path from the target anode, the path intercepting the sample, the x-rays releasing energetic ions from the sample;

a low pressure enclosure containing the electron multiplier and the target anode;

a window in the low pressure enclosure, the window positioned in the path;

a voltage supply assembly coupled to the target anode and the electron multiplier; and a detector positioned proximate the sample for receiving the energetic ions and analyzing the sample.

* * * * *

UNITED STATES PATENT AND TRADEMARK OFFICE

CERTIFICATE OF CORRECTION

PATENT NO. : 5,504,796
DATED : April 2, 1996
INVENTOR : Enio F. DaSilveira, et al.

It is certified that error appears in the above-identified patent and that said Letters Patent is hereby corrected as shown below:

Column 2, line 11, " "EA") " should read -- ("EA")--.

Column 5, line 21, "10-20/xm" should read --10-20 $\mu$m--.

Signed and Sealed this

Second Day of July, 1996

Bruce Lehman

*Attest:*

BRUCE LEHMAN

*Attesting Officer*

*Commissioner of Patents and Trademarks*